US007247028B2

(12) United States Patent
Schriefer

(10) Patent No.: US 7,247,028 B2
(45) Date of Patent: Jul. 24, 2007

(54) MULTIPLE DEGREES OF FREEDOM CONNECTORS AND ADAPTERS

(75) Inventor: Tavis D. Schriefer, Carrollton, TX (US)

(73) Assignee: Ideative Product Ventures, Inc., Carrollton, TX (US)

( * ) Notice: Subject to any disclaimer, the term of this patent is extended or adjusted under 35 U.S.C. 154(b) by 287 days.

(21) Appl. No.: 10/619,535

(22) Filed: Jul. 11, 2003

(65) Prior Publication Data

US 2004/0023520 A1 Feb. 5, 2004

Related U.S. Application Data

(60) Provisional application No. 60/438,467, filed on Jan. 7, 2003, provisional application No. 60/416,569, filed on Oct. 7, 2002, provisional application No. 60/400,792, filed on Aug. 2, 2002.

(51) Int. Cl.
*H01R 39/00* (2006.01)

(52) U.S. Cl. ..... 439/11; 439/8; 439/131; 439/528

(58) Field of Classification Search ..... 439/11, 439/638–640, 21, 131, 174, 136, 6, 8, 13, 439/31, 528, 534, 535; 362/396, 350, 404, 362/430, 410, 220, 225, 431, 250
See application file for complete search history.

(56) References Cited

U.S. PATENT DOCUMENTS

| | | | |
|---|---|---|---|
| 810,244 | A | 1/1906 | Wright |
| 1,953,864 | A | 4/1934 | Morris |
| 2,012,771 | A | 8/1935 | Reynolds |
| 2,259,999 | A | 10/1941 | Bryant |
| 2,652,546 | A | 9/1953 | Christner |
| 2,753,531 | A | 7/1956 | Butler |
| 3,474,376 | A | 10/1969 | Preiss |
| 4,382,647 | A | 5/1983 | Paley |
| 4,643,508 | A | 2/1987 | Schaller |
| 4,673,228 | A | 6/1987 | Ditzig |
| 4,764,121 | A | 8/1988 | Ditzig |
| 4,850,880 | A | 7/1989 | Zayat |
| 4,959,021 | A | 9/1990 | Byrne |

(Continued)

FOREIGN PATENT DOCUMENTS

| | | | |
|---|---|---|---|
| DE | 2217042 | A | 10/1973 |

(Continued)

OTHER PUBLICATIONS

PCT International Search Report for International Application No. PCT/US03/23990 dated Dec. 22, 2003.

*Primary Examiner*—Truc T. Nguyen
*Assistant Examiner*—Edwin A. Leon
(74) *Attorney, Agent, or Firm*—Wong, Cabello, Lutsch, Rutherford & Brucculeri, LLP

(57) ABSTRACT

Connector devices that provide multiple degrees of freedom of motion between a first connector head and additional connector heads and/or electronic devices are described. The multiple degrees of freedom of motion permit motion in one or both of two planes and, perhaps, rotation about an axis in a controlled and fixed manner. Such connector devices allow peripheral devices to be folded or rotated in close proximity to a hosting device. Connector devices that incorporate circuitry for implementing distribution/hub functionality are also described.

25 Claims, 5 Drawing Sheets

U.S. PATENT DOCUMENTS 5,049,083 A 9/1991 Lin
5,082,448 A 1/1992 Kang
5,106,306 A 4/1992 Ditzig
5,186,659 A * 2/1993 Hefner ..... 439/643
5,249,970 A 10/1993 Jennings
5,425,645 A 6/1995 Skovdal
5,562,463 A 10/1996 Tan
5,595,503 A 1/1997 Pittman
5,632,553 A * 5/1997 Huang ..... 362/410
5,634,802 A 6/1997 Kerklaan
5,637,018 A 6/1997 Garguilo
5,658,152 A 8/1997 Selker
5,681,171 A 10/1997 Park
5,681,176 A 10/1997 Ibaraki
5,692,921 A 12/1997 Jennings
5,772,315 A * 6/1998 Shen ..... 362/396
5,772,447 A 6/1998 Cheung
5,796,047 A 8/1998 Sheng-Hsin
5,833,358 A 11/1998 Patik
D416,233 S 11/1999 Tsai
D416,542 S 11/1999 Tsai
D416,868 S 11/1999 Tsai
5,997,310 A 12/1999 Chiu
6,048,211 A 4/2000 Liaom
6,068,490 A 5/2000 Salzberg
6,116,958 A * 9/2000 Reichle ..... 439/640
6,126,460 A 10/2000 Wu
6,193,522 B1 2/2001 Liao
6,213,782 B1 4/2001 Derstine
D444,788 S 7/2001 Do
6,273,734 B1 * 8/2001 Ikeda et al. ..... 439/131
6,273,735 B1 8/2001 Johnson
D454,542 S 3/2002 Nakashima
D454,841 S 3/2002 Nakashima
6,394,813 B1 * 5/2002 Stout et al. ..... 439/11
D459,702 S 7/2002 Watanabe
6,435,904 B1 * 8/2002 Herbst et al. ..... 439/534
6,464,519 B1 10/2002 Hawks
6,490,163 B1 12/2002 Pua
6,544,069 B1 * 4/2003 Enriquez et al. ..... 439/534
6,544,075 B1 * 4/2003 Liao ..... 439/638
6,695,620 B1 2/2004 Huang
6,758,689 B1 * 7/2004 Bair et al. ..... 439/136
6,786,743 B2 9/2004 Huang
2002/0081878 A1 6/2002 Bruno
2003/0018840 A1 1/2003 Chandler

FOREIGN PATENT DOCUMENTS

EP 0736937 A 10/1996
GB 2170064 A 7/1986
JP 53080590 A 7/1978
JP 5021108 A 9/1993
JP 06111903 A 4/1994

* cited by examiner (SIDE VIEW)

(TOP VIEW)

(SIDE VIEW)

(TOP VIEW)

(SIDE VIEW)

(TOP VIEW)

(SIDE VIEW)

(TOP VIEW)

(SIDE VIEW)

(TOP VIEW)

(SIDE VIEW)

(TOP VIEW)

MULTIPLE DEGREES OF FREEDOM CONNECTORS AND ADAPTERS

CROSS-REFERENCE TO RELATED APPLICATIONS

The present patent application claims the benefit of a U.S. provisional patent applications entitled "Electrical or Optical Connector Adapter with Rotational Mechanisms," Ser. No. 60/400,792 (filed on 2 Aug. 2002), Ser. No. 60/416,569 (filed on 7 Oct. 2002) and Ser. No. 60/438,467 (filed on Jan. 7, 2003) by the same inventor.

BACKGROUND

The invention relates generally to connectors and adapters and more particularly, but not by way of limitation, to connectors and adapters that provide multiple degrees of freedom of motion for coupling electronic components.

A large variety of electronic (including electro-optical) devices are currently available on the market. Many of these devices need to be interconnected to other devices to be more useful or desirable. For example, a user may want to connect their notebook computer to an external memory device, a digital camera, MP3 player or a modem. To interconnect these various devices users have traditionally needed a variety of different connectors and/or adaptors. When in use, these connectors and adaptors extend from the hosting device making it difficult or impossible to place the hosting device and/or the connected peripheral device in a desired position. In addition, connectors that extend from a housing (host or peripheral) are prone to breakage, bad connections or damage to the connected device or the hosting device itself. In a desktop environment, these problems may be tolerable in so far as the host device and the connector/adapter may be placed in a location out of harms way. In a mobile environment however (e.g., a notebook or handheld computer, a cellular telephone and a digital camcorder), the use of connectors and/or adaptors that extend from the base unit's body are particularly troublesome.

These problems are particularly problematic for the newest types of small devices designed to be directly interfaced to host devices. Illustrative small devices include, but are not limited to, card readers, BlueTooth, networking and biometric devices. Many of these small devices have connector heads attached directly to the bodies of the devices. In some cases the small device cannot be successfully interfaced to a host device due to the physical conflicts between the housing of the host device and the small device. For example, the orientation of a connector head on a notebook computer may not match the orientation of the connector head on a memory card device. Another common problem is that the host device connector head/socket is oriented in such a manner that the peripheral device (e.g., a card reader) cannot be plugged into the host without creating physically conflicts with other devices or infrastructure (e.g., a wall or seat).

Some prior art devices provide connectors that allow one degree of freedom of motion—motion that may partially reduce the aforementioned problems. Some prior art devices, for example, are able to bend, i.e. rotate along an axis that is perpendicular to the direction that one connector head is inserted into another connector head to make a connection. These connectors allow a hosting device and a peripheral device to be joined in places or situations where fixed connectors would not. Other prior art connectors may allow peripheral device connector head to rotate or spin such that a host and a peripheral device may be connected even if the connector head on the peripheral device has a different horizontal or vertical orientation from that of the host device. All these devices, however, continue to extend the coupled device in a predetermined orientation away from the hosting device.

Thus, it would be beneficial to provide a mechanism that would allow one or more devices to be coupled through an arbitrary and fixable orientation and which allow devices to be coupled in a low-profile manner. Such a mechanism would overcome physical connection constraints present in current connectors and adaptors.

SUMMARY

In one embodiment, the invention provides a connector having multiple degrees of freedom of movement. The connector comprises a first connector head having an axis, a second connector head and a connection mechanism coupling the first and second connector heads, wherein the connection mechanism is adapted to limit the motion of the second connector head (relative to the first connector head) in a first plane substantially coincident with the axis and in a second plane substantially orthogonal to the axis. The connector may further comprise additional connector heads, an electronic device and/or an additional connection mechanism to permit rotation of the second connector head and/or electronic device about the axis. In some embodiments the additional connector heads or electronic device may move independent of one another while, in other embodiments, they move coincident with one another. In still other embodiments, connectors in accordance with the invention may be incorporated within electronic devices. In yet other embodiments, the second connector head may be at a fixed angle relative to the first connector head.

Connectors in accordance with some embodiments of the invention provide connector heads that may be fixedly set in a user-preferred position—a position that changes only on affirmative action by a user. Connectors in accordance with the invention may implement any desired connector head. Illustrative connector head types include, but are not limited to, Universal Serial Bus (USB), FireWire, video monitor and serial connector heads. Further, connectors in accordance with the invention may employ different connector head styles (e.g., USB and serial connector heads) within a single connector apparatus. Connectors in accordance with the invention may be embodied in electrical or electro-optical connectors and may further be incorporated within devices such as, for example, memory devices (e.g., flash memory disk, magnetic disk drive and optical disk drive peripherals), card readers (e.g., secure data and multimedia cards) and communication devices (e.g., wireless modem and standard modem peripherals).

BRIEF DESCRIPTION OF THE DRAWINGS

FIG. 3A shows an electronic device coupled to a host device via a prior art connector, while

DETAILED DESCRIPTION

Figure 1A:
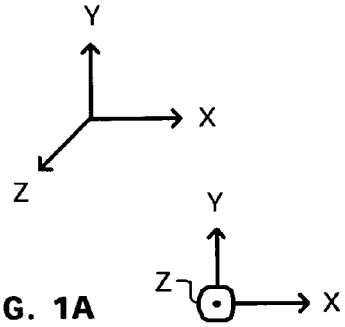
FIGS. 1A through 1C illustrate a right-handed coordinate system.
Figure 1B:
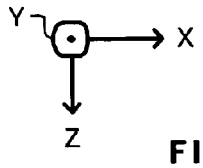
Figure 1C:
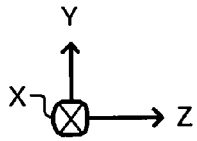

The invention relates generally to connectors and adaptors and more particularly, but not by way of limitation, to mechanisms that provide two or more degrees of freedom for coupling two or more devices in an arbitrary and fixable orientation. The following embodiments of the invention, described in terms of Universal Serial Bus (USB) connectors and adaptors, are illustrative only and are not to be considered limiting in any respect. To facilitate the following discussion, the standard right-hand coordinate system shown in FIGS. 1A through 1C is hereby adopted.

Figure 2A:
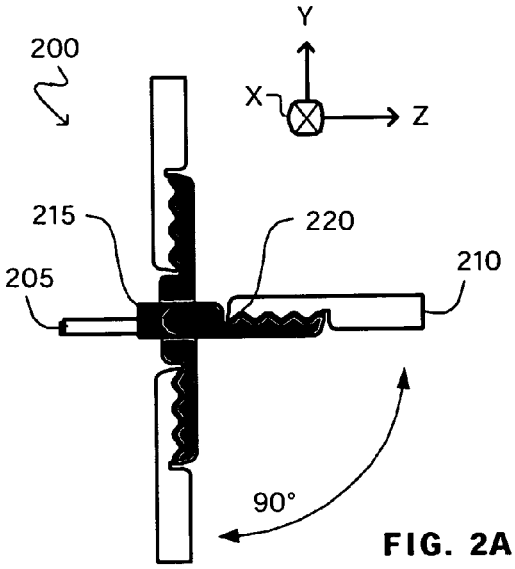
FIGS. 2A and 2B show a connector in accordance with one embodiment of the invention.
Figure 2B:
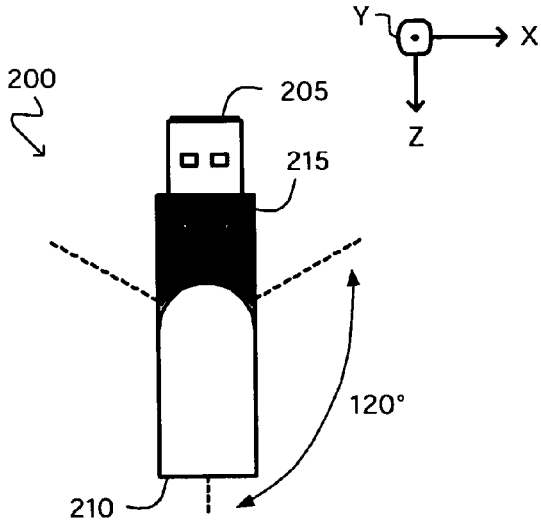

In one embodiment of the invention, two-degree of freedom USB connector 200 allows motion in both the Y-Z plane (side view, FIG. 2A) and the X-Z plane (top view 2B). In this embodiment, connector 200 has male connector head 205 and female connector head 210. Between connector heads 205 and 210 are two connection mechanisms 215 and 220. Mechanism 215 allows connector head 210 to rotate in the Y-Z plane, while mechanism 220 allows connector head 210 to rotate in the X-Z plane. As illustrated in FIG. 2A, rotational mechanism 215 has an approximately ±90° range of motion relative to the long axis of connector head 205. As illustrated in FIG. 2B, rotational mechanism 220 allows rotation of connector 210 in the X-Z plane of up to approximately 120° (clockwise or counterclockwise). In use, connector 200 may be used to couple a hosting device (e.g., a notebook computer) via connector head 205 to a peripheral device (e.g., a portable USB device) via connector head 210. In accordance with connector 200, the peripheral device may be folded and/or rotated in close proximity to the hosting device. While connector heads 205 and 210 are illustrated as being standard USB connector heads, this is not required. For example, connector heads 205 and 210 could be a mini-USB connector heads. In addition, connector heads 205 and 210 could be different "style" connector heads. For example, connector head 205 could be a standard USB connector head while connector head 210 could be a Serial connector head, a mini-USB, etc.

In another embodiment, one or both of mechanisms 215 and 220 provide a fixedly adjustable positioning mechanism. That is, either or both of mechanisms 215 and 220 may be designed to retain a user-specified position and to hold that position until affirmatively altered. In these embodiments, an applied external force is required to place mechanisms 215 and 220 in a first position, wherein the weight of the connector heads and/or stand-alone device would not generally be sufficient to rotate either mechanism 215 or 220. One of ordinary skill in the art will recognize there are many means to implement this feature. For example, a hinge for rotation and friction for holding a connector in place is one means. Another means may use two mating planar surfaces to keep the rotation motion along a predetermined track or path and also increase the surface area for more stationary friction when a desirable position is reached. A third means could use a ball and socket universal joint similar in function to those used in conventional shower-heads.

Figure 3A:
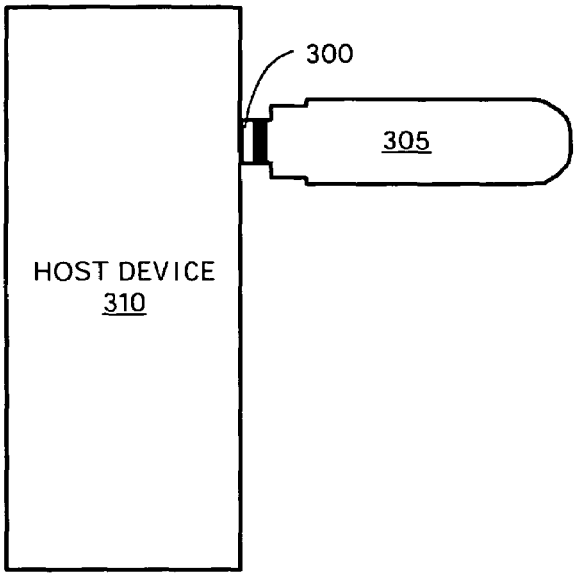
FIG. 3A (PRIOR ART)
Figure 3B:
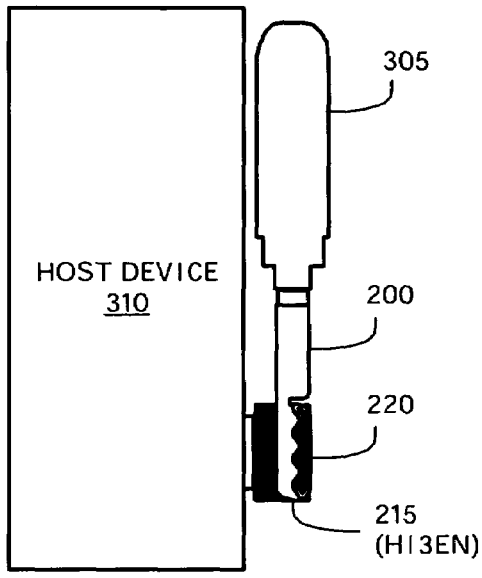
FIG. 3B shows the electronic device coupled to the host device via a connector in accordance with FIGS. 2A and 2B.

FIG. 3A illustrates the use of prior art USB connector 300 to couple memory device 305 to host computer 310. As shown, memory device 305 extends a significant distance out from host computer 310. As a result, host computer 310 must be placed further away from external obstacles than may be desired or possible and is subject to breakage as indicated above. In contrast, when memory device 305 is coupled to host computer 310 through connector 200, memory device 305 may be rotated in both the Y-Z (via mechanism 215) and X-Z (via mechanism 220) planes to conveniently place memory device 305 (or any peripheral) in close proximity to host computer 310.

Figure 4A:
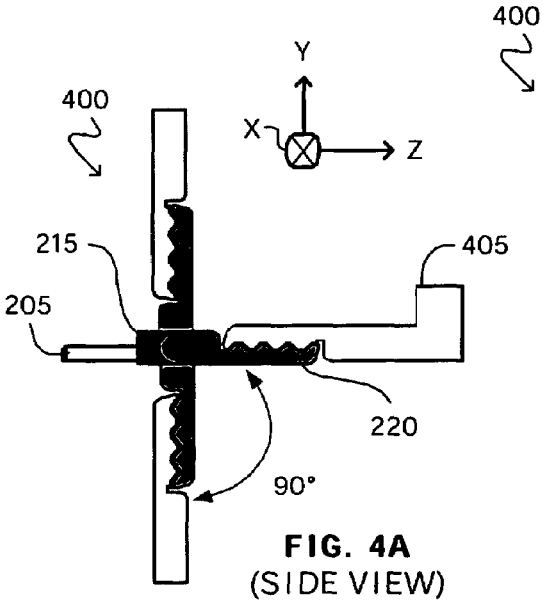
FIG. 4 illustrates an embodiment of the invention wherein one connector head is integral to an electronic device.
Figure 4B:
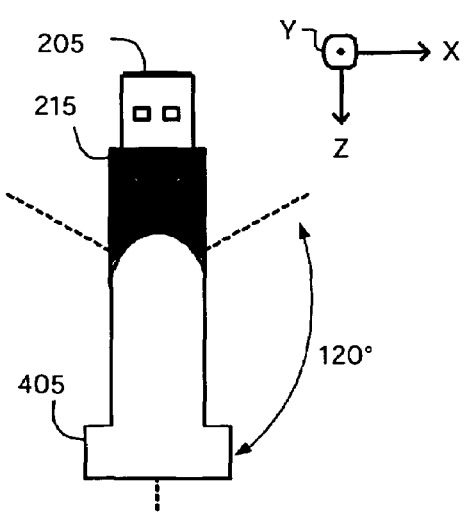

In accordance with another embodiment of the invention, connector head 210 may be fixedly coupled or integral to a functional unit such as, for example, an electronic device. Illustrative electronic devices include, but are not limited to, card readers, memory devices and wireless network devices. FIGS. 4A and 4B, for example, illustrate an embodiment in which connector 400 comprises a standard USB connector head 205 while the second connector head (e.g., connector head 210 of FIG. 2) is integral to electronic device 405. By way of example, and as noted above, electronic device 405 could be a card reader, memory device or wireless network device.

Figure 5A:
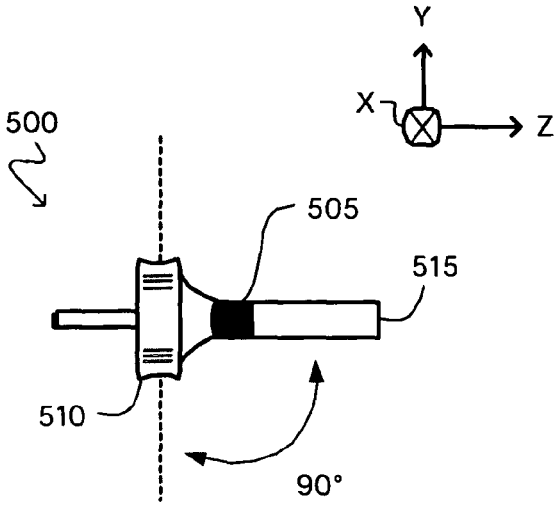
FIGS. 5A and 5B show a connector in accordance with another embodiment of the invention.
Figure 5B:
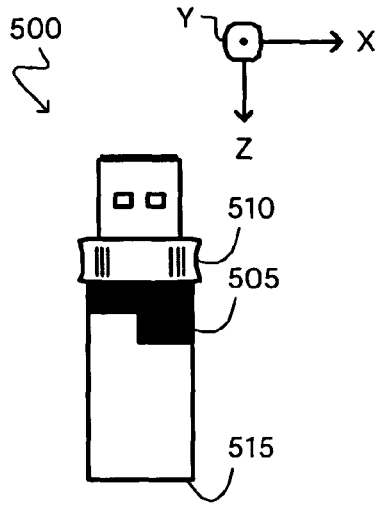

In yet another embodiment (see FIGS. 5A and 5B), USB connector 500 provides mechanism 505 for rotational motion in the Y-Z plane in a manner as illustrated in FIG. 2A (mechanism 215) and mechanism 510 for rotation of connector head 515 about the Z axis. In the illustrated embodiment, mechanism 510 provides approximately 359° of rotation about the Z axis.

Figure 6A:
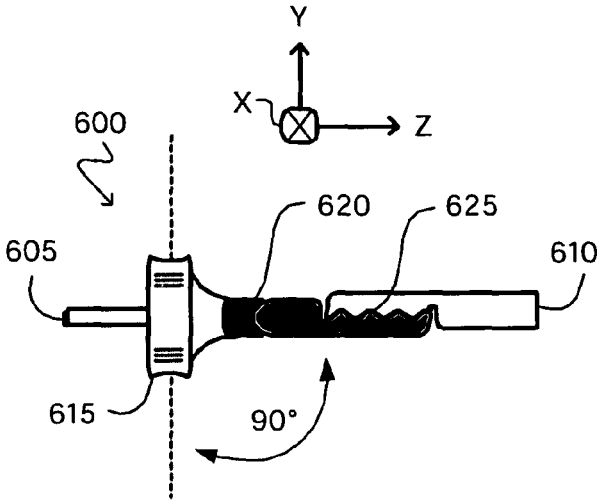
FIGS. 6A and 6B show yet a connector in accordance with yet another embodiment of the invention.
Figure 6B:
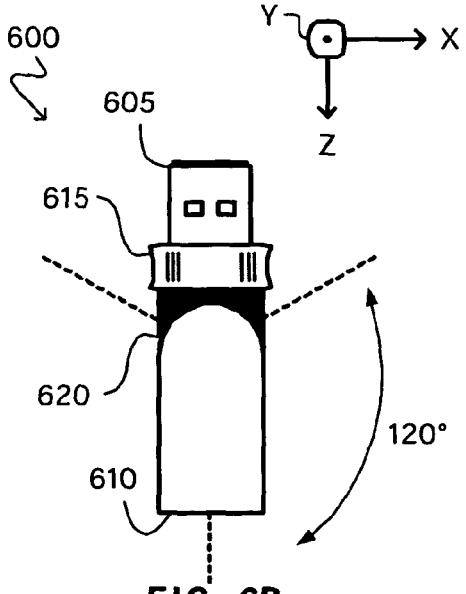

In still another embodiment, mechanism 510 may be incorporated into connector 200 to provide three degrees of motion. As shown in FIGS. 6A and 6B, connector 600 permits connector heads 605 and 610 to be rotated about the Z-axis via mechanism 615, rotated in the Y-Z plane via mechanism 620 and rotated in the X-Z plane via mechanism 625. One of ordinary skill in the art will recognize and appreciate that connector 600 could be incorporated into an electronic device in a manner described above with respect to connector 200 (see FIG. 4).

Figure 7A:
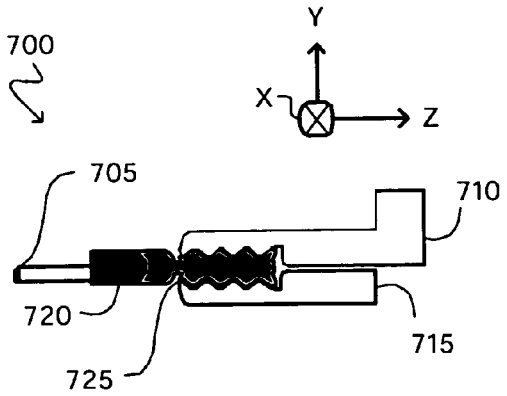
FIGS. 7A and 7B show a connector assembly in accordance with the invention that incorporates an electronic device.
Figure 7B:
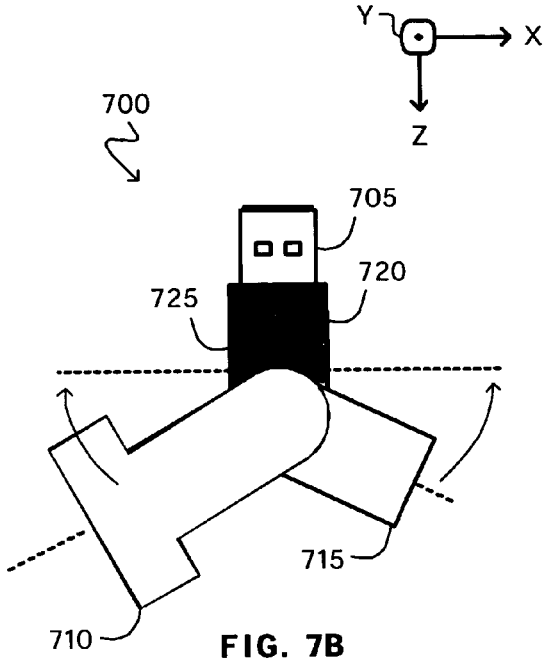

In one embodiment of the invention, the fixed device capability of FIG. 4 may be combined with the connector of FIG. 2, 5 or 6 to provide an apparatus having a device (e.g., a fixed memory device or a card reader) and a second connector head. Referring now to FIG. 7, connector 700 provides connectivity through host connector head 705 to both device 710 and second connector head 715. In the illustrated embodiment, device 710 and connector head 715 may move independent of one another via mechanism 725. In another embodiment, however, device 710 and connector head 715 may be mechanically coupled so that they move coincident with one another—that is, together. For convenience, FIG. 7 illustrates the functional combination of FIGS. 2 and 4 only. One of ordinary skill in the art will understand that mechanism 510 (see FIG. 5) may also be incorporated into connector 700 to provide an additional degree motion.

Figure 8A:
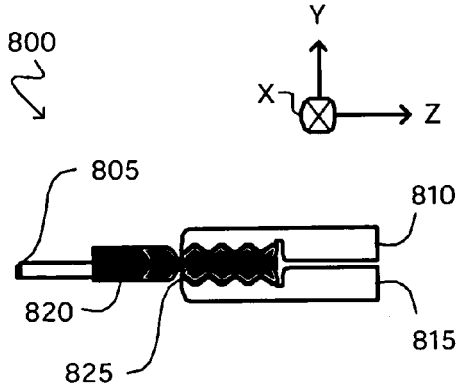
FIGS. 8A and 8B show a connector in accordance with still another embodiment of the invention.
Figure 8B:
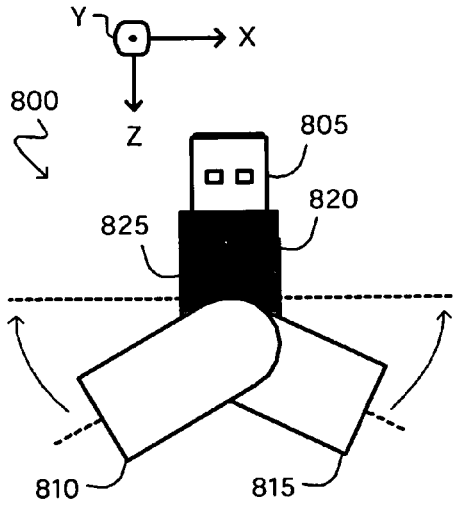

Referring to FIG. 8, in yet another embodiment of the invention connector 800 allows a plurality of devices to be coupled to a single host system in a "hub" configuration. A side view of connector 800 is shown in FIG. 8A. A top view of connector 800 is shown in FIG. 8B. As shown, male connector head 805 may couple directly to a host system (e.g., a notebook or desk-top computer system) while female connector heads 810 and 815 may be coupled to peripheral devices. (One of ordinary skill in the art will recognize that connector heads 810 and 815 do not need to be female. One of 810 and 815 may be male and the other may be female.) Similar to mechanism 215 in FIG. 2, mechanism 820 provides rotation in the Y-Z plane. Similar to mechanism 220, mechanism 825 provides rotation in the X-Z plane for each of connector heads 810 and 815 independently of one another. In one embodiment, connector 800 acts as a USB hub with the necessary circuitry to implement the hub function enclosed within, for example, mechanism 825. Embodiments in accordance with connector 800, allow a single device to provide connectivity to two peripherals, both of which may be retained in close proximity to the host device without interference with the host device, one another or a component in the external environment. One of ordinary skill in the art will appreciate that connector 800 could also incorporate mechanism 510 of FIG. 5 to provide a mechanism permitting three degrees of motion.

Figure 9:
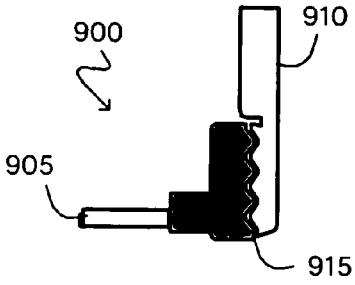
FIGS. 9, 10, 11 and 12 show connectors in accordance with additional embodiments of the invention.
Figure 10B:
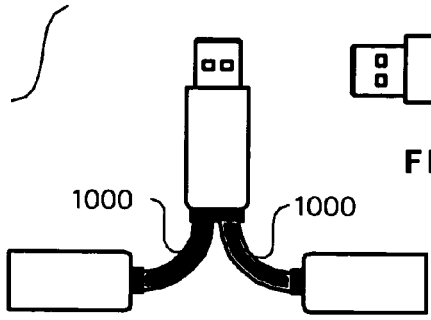
Figure 10A:
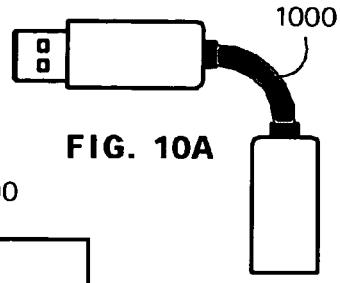
Figure 11:
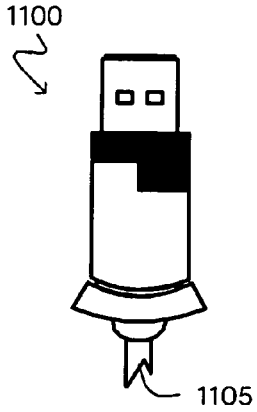
Figure 12:
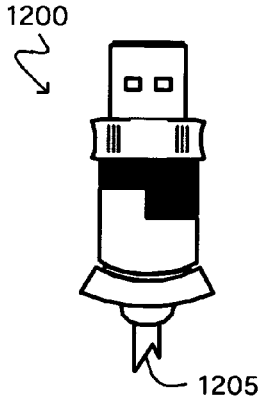

Additional embodiments of a connector/adapter in accordance with the invention are shown in FIGS. 9 through 12. In FIG. 9, connector 900 comprises male connector head 905 that is fixedly oriented at 90° to female connector head 910, where connector mechanism 915 provides rotation of connector head 910 in the X-Z plane. It will be recognized that connector 900 may also provide multiple connector capability similar to that illustrated in FIG. 8, albeit in a plane orthogonal to the plane of connector head 905. FIGS. 10A and 10B illustrate two embodiments in which rotational control of one or more connector heads in all planes is achieved by use of a goose-neck or flexible jointed pipe 1000. FIG. 11 illustrates a connector similar to that shown in FIG. 2, except that one end of connector 1100 is coupled to cable 1105 rather than another connector head. Similarly, FIG. 12 illustrates a connector similar to that shown in FIG. 5, except that one end of connector 1200 is coupled to cable 1205 rather than another connector head. It will be recognized that cable 1105 and 1205 may have at their distal end (not shown) a connector head. It will further be recognized that connectors 900 and 1100 could incorporate mechanism 510 (see FIG. 5) to provide an additional degree of motion.

Figure 13A:
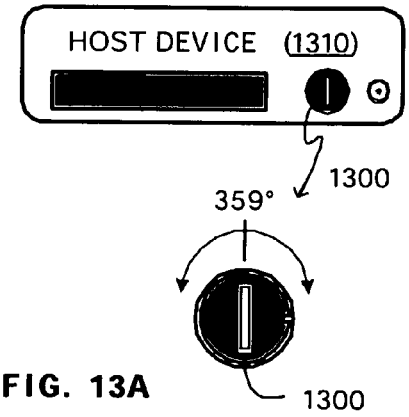
FIGS. 13A and 13B show a connector in accordance with the invention incorporated within a host device.
Figure 13B:
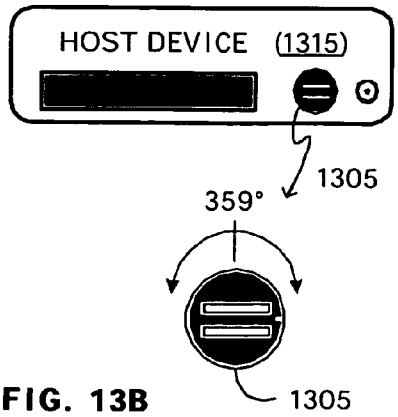

Referring to FIGS. 13A and 13B, rotational-only embodiments 1000 and 1005 of the invention may be built directly into host device 1010 and 1015 respectively. In accordance with these embodiments, rotational elements 1000 and 1005 permit rotation up to approximately 359° so that whatever the orientation of the connector on a peripheral device may happen to be, the connector on the hosting device can be rotated to accommodate the need of the peripheral device.

Various changes in the disclosed embodiments are possible without departing from the scope of the claims. For instance, while the embodiments of FIGS. 2 through 10 have been shown in terms of a USB-type connector, the invention is not so limited. Any connectors used to make electrical or electro-optical data connections can benefit from the invention. For example, Universal Serial Bus (as defined, for example, in the USB 2.0 specification), FireWire (as defined in the I.E.E.E. 1394 standard), BlueTooth (as defined in the BlueTooth specification and published by the BlueTooth Special Interest Group), video monitor, RS232 and fiber optic connectors are all within the scope of the invention and the claims below. Peripheral devices that may benefit from an adjustable connector in accordance with the invention include, but are not limited to, data storage devices, card readers (e.g., Secure Data and Multimedia Card readers) BlueTooth or other communication devices, security devices, lights, fans, cables, antennas, and power adapters. Hosting devices that can benefit from the adjustable connector include, but are not limited to, desktop computers, notebook computers, personal digital assistants (PDAs), cellular telephones, digital cameras or camcorders etc. Accordingly, it is the following claims and not the description of the above detailed embodiments which are intended to define the scope of the invention.

What is claimed is:

1. A connector comprising:

a first connector head having an axis;

a second connector head;

a connection mechanism coupling the first connector head and the second connector head, wherein the connection mechanism is adapted to permit limited motion of the second connector head in first and second planes relative to the first connector head, the first plane being substantially coincident with the axis, the second plane being substantially orthogonal to the axis; and a third connector head coupled to the connection mechanism, the connection mechanism adapted to permit limited motion of the third connector head in the first and second planes relative to the first connector head, wherein the second and third connector heads are adapted to move independent of each other in one of the first and second planes, wherein the second and third connector heads are adapted to move together in the other of the first and second planes, and wherein at least one of the connector heads comprises a device slot selected from the group consisting of Universal Serial Bus, FireWire, BlueTooth, video, RS232 and memory device slots.

2. The connector of claim 1, wherein at least one of the connector heads comprises an electronic device selected from the group consisting of Universal Serial Bus, FireWire, BlueTooth, video, RS232 and memory devices.

3. The connector of claim 1, wherein at least one of the connector heads comprises a cable.

4. The connector of claim 1, wherein the first connector head is fixedly coupled to an electronic device selected from the group consisting of personal digital assistant, telephone, camera and personal computer electronic devices.

5. The connector of claim 1, wherein the first connector head comprises a different connector head style from at least one of the second and third connector heads.

6. The connector head of claim 1, wherein the connection mechanism is further adapted to comprise means for implementing a hub function between the first connector head and the second and third connector heads.

7. The connector of claim 1, wherein the connection mechanism is further adapted to retain the second connector head in a specified position in the first plane and further adapted to retain the second connector head in another specified position in the second plane.

8. The connector of claim 7, wherein the connection mechanism is further adapted to retain the third connector head in a specified position in the first plane and further adapted to retain the third connector head in another specified position in the second plane.

9. A connector, comprising:

an intermediate portion defining first and second axes of rotation, the second axis of rotation being substantially orthogonal to the first axis of rotation;

a first connector head coupled to the intermediate portion and being rotatable in a first plane about the first axis of rotation;

a second connector head in electrical communication with the first connector head, the second connector head coupled to the intermediate portion and being rotatable in a second plane about the second axis of rotation; and a third connector head in electrical communication with the first connector head, the third connector head coupled to the intermediate portion and being rotatable in the second plane about the second axis of rotation, wherein the first and second axes of rotation permit the second and third connector heads to be selectively positioned in the first and second planes relative to the first connector head, wherein the second and third connector heads are rotatable in the second plane independent of each other, and wherein at least one of the connector heads comprises a device slot selected from the group consisting of Universal Serial Bus, FireWire, BlueTooth, video, RS232, and memory device slots.

10. The connector of claim 9, wherein the intermediate portion comprises means for implementing a hub function between the first connector head and the second and third connector heads.

11. The connector of claim 9, wherein at least one of the connector heads comprises an electronic device selected from the group consisting of Universal Serial Bus, FireWire, BlueTooth, video, RS232, and memory devices.

12. The connector of claim 9, wherein the intermediate portion at the first axis of rotation comprises a first fixedly adjustable positioning mechanism adapted to retain the intermediate portion and its second axis of rotation in a selectable one of a plurality of positions in the first plane relative to the first connector head.

13. The connector of claim 12, wherein the intermediate portion at the second axis of rotation comprises a second fixedly adjustable positioning mechanism adapted to retain the second connector head in a selectable one of a plurality of positions in the second plane.

14. A connector, comprising:

an intermediate portion having a first end and a second end, the first end having a first hinged connection defining a first axis of rotation, the second end having a second hinged connection defining a second axis of rotation being substantially orthogonal to the first axis of rotation;

a first connector head coupled to the first hinged connection and being rotatable in a first plane about the first axis of rotation; and a second connector head in electrical communication with the first connector head, the second connector head coupled to the second hinged connection and being rotatable in a second plane about the second axis of rotation, wherein the first and second axes of rotation permit the second connector head to be selectively positioned in the first and second planes relative to the first connector head, and wherein at least one of the connector heads comprises a device slot selected from the group consisting of Universal Serial Bus, FireWire, BlueTooth, video, RS232 and memory device slots.

15. The connector of claim 14, wherein the second hinged connection comprises a fixedly adjustable positioning mechanism adapted to retain the second connector head in a selectable one of a plurality of positions in the second plane.

16. The connector of claim 14, wherein at least one of the connector heads comprises an electronic device selected from the group consisting of Universal Serial Bus, FireWire, BlueTooth, video, RS232 and memory devices.

17. The connector of claim 14, further comprising a third connector head in electrical communication with the first connector head, the third connector head coupled to the second hinged connection and being rotatable in the second plane about the second axis of rotation.

18. The connector of claim 17, wherein the second and third connector heads are rotatable together in the first plane and are rotatable independent of each other in the second plane.

19. The connector of claim 17, wherein the intermediate portion comprises means for implementing a hub function between the first connector head and the second and third connector heads.

20. A connector, comprising:

a first connector head defining a first axis of rotation;

an intermediate portion coupled to the first connector head and being rotatable in a first plane about the first axis of rotation, the intermediate portion defining a second axis of rotation substantially orthogonal to the first axis of rotation and defining a third axis of rotation substantially orthogonal to both the first and second axes of rotation, wherein the second and third axes of rotation are rotatable together in the first plane about the first axis of rotation, wherein the third axis of rotation is rotatable in a second plane about the second axis; and a second connector head in electrical communication with the first connector head, the second connector head coupled to the intermediate portion and being rotatable in a third plane about the third axis of rotation, wherein the first, second, and third axes of rotations permit the second connector head to be selectively positioned relative to the first connector head in the first, second, and third planes, and wherein at least one of the connector heads comprises a device slot selected from the group consisting of Universal Serial Bus, FireWire, BlueTooth, video, RS232 and memory device slots.

21. The connector of claim 20, further comprising a fixedly adjustable positioning mechanism at one or more of the first, second, and third axes of rotation adapted to retain the second connector head in a selectable one of a plurality of positions relative to the first connector head.

22. The connector of claim 20, wherein at least one of the connector heads comprises an electronic device selected from the group consisting of Universal Serial Bus, FireWire, BlueTooth, video, RS232 and memory devices.

23. The connector of claim 20, further comprising a third connector head in electrical communication with the first connector head, the third connector head coupled to the intermediate portion and being rotatable in the third plane about the third axis of rotation.

24. The connector of claim 23, wherein the second and third connector heads are rotatable together in the first and second planes and are rotatable independent of each other in the third plane.

25. The connector of claim 23, wherein the intermediate portion comprises means for implementing a hub function between the first connector head and the second and third connector heads.

* * * * *